US005515632A

United States Patent [19]

Gebka et al.

[11] Patent Number: 5,515,632

[45] Date of Patent: May 14, 1996

[54] LOCK WINDOW FOR PRICE CHANNELS

[75] Inventors: John Gebka, Coral Springs; James Murray, Ft. Lauderdale, both of Fla.

[73] Assignee: FEMC Ltd., Ft. Lauderdale, Fla.

[21] Appl. No.: 356,713

[22] Filed: Dec. 15, 1994

[51] Int. Cl.[6] ..... G09F 13/00

[52] U.S. Cl. ..... 40/642; 40/649

[58] Field of Search ..... 40/642, 649, 650

[56] References Cited

U.S. PATENT DOCUMENTS

| | | | |
|---|---|---|---|
| 3,254,432 | 6/1966 | Wassell | 40/650 |
| 3,320,690 | 5/1967 | Forsburg | 40/650 |
| 5,394,632 | 3/1995 | Gebka et al. | 40/642 |

FOREIGN PATENT DOCUMENTS

| | | | |
|---|---|---|---|
| 511468 | 11/1992 | European Pat. Off. | 40/642 |
| 3513234 | 10/1987 | Germany | 40/642 |
| 2189640 | 10/1987 | United Kingdom | 40/642 |
| 2191031 | 12/1987 | United Kingdom | 40/649 |

OTHER PUBLICATIONS

EZ-View Bar Code Label Channels (p. 10)—Publication Date Apr. 15, 1994.

*Primary Examiner*—Kenneth J. Dorner
*Assistant Examiner*—Cassandra Davis
*Attorney, Agent, or Firm*—Jacobson, Price, Holman & Stern

[57] ABSTRACT

A plastic price channel for attachment along the front edge of a merchandise display shelf to carry labelling pertaining to articles on the shelf has a main body panel and a see-through cover joined to the body panel along its bottom edge so that non-adhesive labels can be fitted between the body panel and the cover. The top edge of the cover can be engaged behind a resilient top lip on the body panel to releasably lock the cover in place and a forwardly extending channel-shaped formation is provided along the top edge of the cover in which the top lip is received. The channel-shaped formation has an upwardly extending outer limb forming a gripping element by which the top edge of the cover can be disengaged from behind the top lip by finger pressure exerted downwardly on the gripping element.

9 Claims, 2 Drawing Sheets

LOCK WINDOW FOR PRICE CHANNELS

BACKGROUND OF THE INVENTION

This invention relates to plastic price channels of the kind used on merchandise display shelves, for example in retail outlets such as supermarkets, drugstores or the like, to receive labels providing information relating to merchandise being displayed on the shelves.

Many merchandise display shelves have their front edge formed as an integrated C-shaped price channel which can receive snap-in labels directly. Other shelves have plain fronts. In any event, it has become quite common to use an additional plastic price channel on either type of shelf. The plastic price channel can, for example, be sized to receive particular size labels or label holders, and can be attached to a shelf at an angle which better suits viewing by shoppers particularly in the case of low-down or high-up shelves. Plastic price channels can be designed to clip into a price channel which is integrally formed on a shelf or to adhere to a plain-fronted shelf.

Also, plastic price channels oftentimes are provided with a front cover, or window generally attached along the bottom edge of the price channel, behind which non-adhesive labels can be secured. In certain designs, the cover is attached so that labels can also be received in front of the cover in which case the label should be of a size to snap in place between upper and lower forwardly extending edges or lips formed on the price channel and/or on the cover. It is also convenient, for example for added security, for the free top edge of the cover to releasably snap in place behind the forwardly extending lip at the top of the price channel. In this case, some gripping mechanism should be provided on the cover to facilitate releasing its top edge when a label is to be inserted or withdrawn from behind the cover.

SUMMARY OF THE INVENTION

It is an object of the invention to provide a plastic price channel of the kind described above having a front cover, a locking mechanism for releasably securing the top edge of the cover behind a forwardly extending top lip of the price channel, and a gripping section on the cover which facilitates release of the locking mechanism when access is required to a label-receiving space behind the cover.

According to the invention, the top edge of the cover engages behind a forwardly and downwardly extending top lip of the price channel and the top edge of the cover is provided with a forwardly extended channel-like formation in which the top lip is received, the channel-like formation including an outer limb which extends upwardly outside of the top lip to form a gripping element whereby the top edge of the cover can be released from engagement behind the lip by downward and/or outward finger pressure applied to the gripping element.

In a preferred form of the invention, the top lip of the price channel has a lower edge formed as a rounded bead to facilitate engagement and disengagement of the top edge of the cover.

Additional features and advantages of the invention will become apparent from the ensuing description and claims taken in conjunction with the attached drawings.

DESCRIPTION OF PREFERRED EMBODIMENTS

Figure 1:
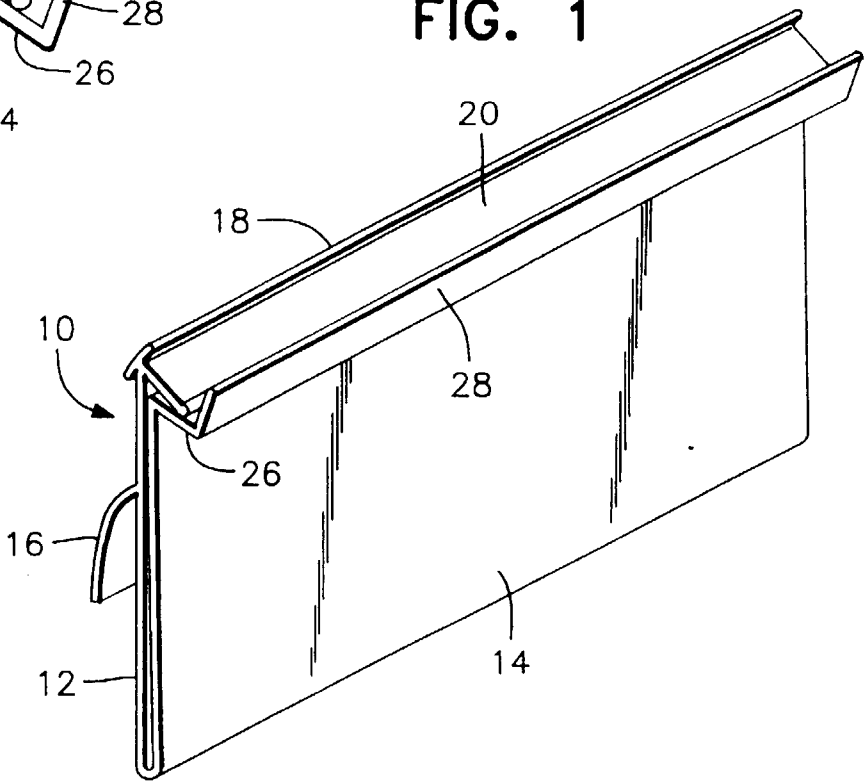
FIG. 1 is a perspective view of a first embodiment plastic price channel according to the invention.
Figure 3:
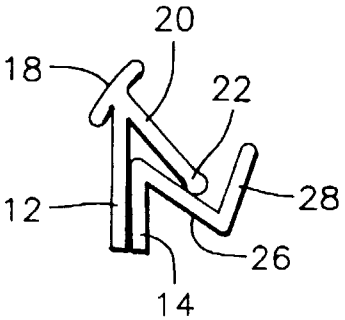
FIG. 3 is an enlarged end elevational view of the top part of the price channel.
Figure 2:
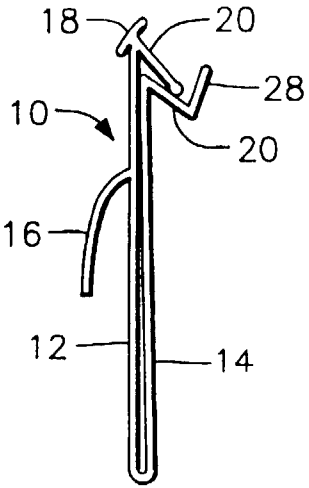
FIG. 2 is an end elevational view of the price channel.

Referring initially to FIGS. 1–3, there is illustrated an integrally extruded plastic price channel 10 comprising a main body panel 12, a front cover 14 joining the main body panel at the bottom of the price channel, and a rearwardly extending leg 16 on the body panel which, in conjunction with a barb 18 along the top edge of the body panel, is intended for use in clipping the price channel in place in an existing price channel formed along the front of a merchandise display shelf, for example in the manner disclosed in copending U.S. patent application Ser. No. 8/045,438 now U.S. Pat. No. 5,394,632 filed Apr. 9, 1993 which is co-assigned herewith and the contents of which are expressly incorporated herein by reference.

The purpose of the illustrated price channel is to accommodate a non-adhesive label, labels, or the like in the space between panel 12 and cover 14. Accordingly, at least the cover should be translucent or transparent and it may be the same or a different plastic from panel 12, in the latter case being coextruded with panel 12 along the bottom edge of the price channel. Also, to improve security in retaining labels, the top edge of the cover and the top edge of panel 12 are designed to releasably lock together in a manner described below.

The top edge of panel 12 is formed with a forwardly and downwardly directed lip 20 under the barb 18 and terminating in a rounded bead 22. The top edge 24 of cover 14 is of a height to be engaged behind lip 20 and the top edge of the cover is provided with a forwardly extending channel-shaped formation defined by an inner downwardly directed limb 26 and an outer upwardly directed limb 28. When the top edge of the cover is engaged behind lip 20, bead 22 fits in the channel between limbs 26 and 28. Limb 28 accordingly defines a gripping element for releasing the top edge of the cover from engagement behind lip 20 by downwardly and/or outwardly exerted finger pressure on the top edge of limb 28. As seen in FIG. 3, for example, the top edge of limb 28 is spaced outwardly from lip 20 above the bead 22, so that an open channel-like formation is formed between lip 20 and limb 28. The inherent resiliency of lip 20 allows the top edge of the cover to be snapped into or out of engagement behind lip 20, for label insertion and removal, and rounded bead 22 facilitates this action by providing a smooth camming surface.

Figure 2A:
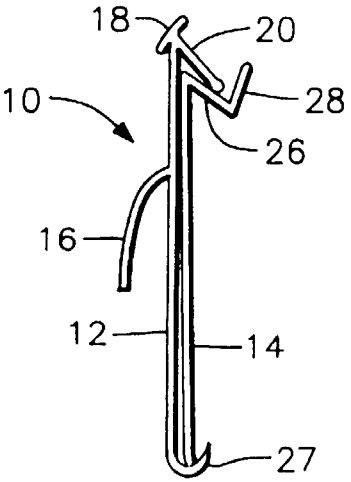
FIG. 2A is a view similar to FIG. 2 of a modified price channel.

As illustrated in FIGS. 1–3, at the bottom of the price channel is a smooth transition between panel 12 and cover 14. In an alternative arrangement, as shown in FIG. 2A, there can be a forwardly projecting lip 27 at the bottom in front of cover 14 for example as disclosed in the above-noted copending patent application. This arrangement allows label holders or J-hooks to be gripped in front of cover 14 between the lip at the bottom and limb 26 at the top.

Figure 6:
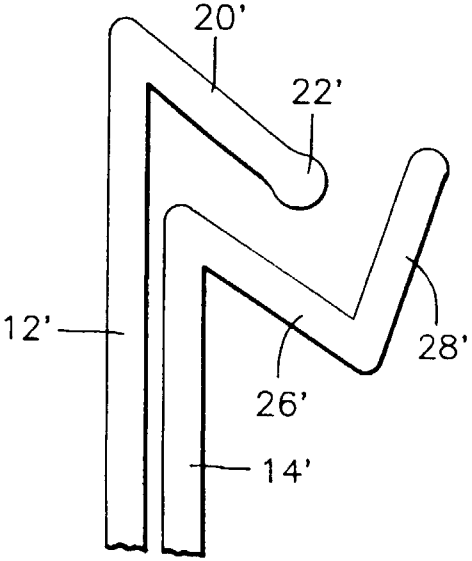
FIGS. 4, 5 and 6 are views corresponding to FIGS. 1, 2 and 3 of a second embodiment price channel according to the invention.
Figure 4:
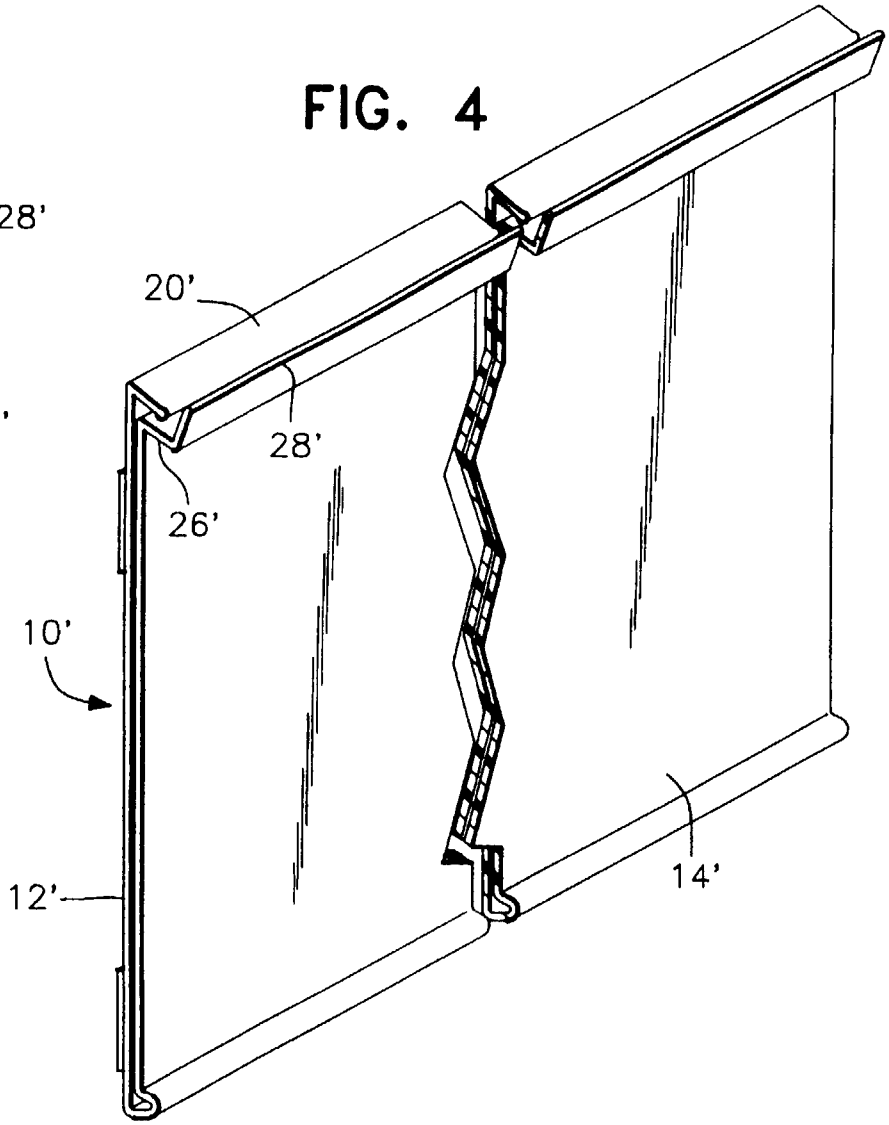
Figure 5:
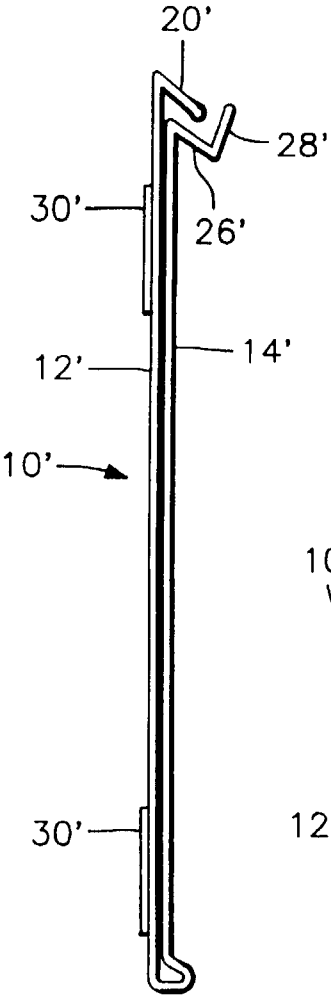

The price channel 10 illustrated in FIGS. 4–6 is similar to price channel 10 and like reference numerals (primed) are used to denote the like parts. In this case, however the leg 16 and barb 18 are eliminated and replaced by adhesive strips 30' along the back of panel 12'. This price channel is intended for attachment, by adhesion to a plain fronted shelf which does not have its own built-in C-channel.

While only preferred embodiments of the invention have been described in detail, the invention is not limited thereby and modifications are possible within the scope of the attached claims.

We claim:

1. A plastic price channel for attachment along a front edge of a merchandise display shelf to carry labelling relating to articles on the shelf, the price channel comprising a main body panel having a top edge, a bottom edge, a front surface and a back surface, an attachment on the main body panel for releasably securing the price channel along the front-edge of a merchandise display shelf, a resilient forwardly and downwardly extending top lip along the top edge of the main body panel, a see-through cover joining the main body panel along the bottom edge, the cover having a height such that a top edge of the cover can be releasably engaged behind said top lip, and a forwardly extending channel-shaped formation along the top edge of the cover comprising an inner downwardly extending limb and outer upwardly extending limb between which limbs said top lip is received when the top edge of the cover is thus engaged, said top lip having a lower edge and said outer limb having an upper edge spaced outwardly from said top lip above said lower edge of the top lip to define an open channel-like formation between said top lip and said outer limb, said outer limb forming a gripping element by which the top edge of the cover can be disengaged from behind said top lip by finger pressure exerted from above downwardly and outwardly on said upper edge of said outer limb.

2. A price channel as claimed in claim 1 wherein said lower edge of the top lip is in the form of a rounded bead.

3. A price channel as claimed in claim 1 wherein the cover is of the same material as the main body panel and is an integral extrusion therewith.

4. A price channel as claimed in claim 1 wherein the cover is of a different material than the main body panel and is joined to the main body panel by co-extrusion.

5. A price channel as claimed in claim 1 wherein the attachment means comprises a barb along the top edge of the main body panel above the top lip, and a downwardly extending leg on the back surface of the body panel, said barb and leg for clipping the price channel into an existing C-channel along the front of a shelf.

6. A price channel as claimed in claim 1 wherein the attachment comprises adhesive on the back surface of the main body panel.

7. A price channel as claimed in claim 1 wherein said inner limb and said outer limb together have a substantially V-shaped cross-section.

8. A price channel as claimed in claim 1 wherein the body panel has a forwardly projecting bottom lip along said bottom edge and the cover is joined to the body panel behind said bottom lip.

9. A price channel as claimed in claim 1 wherein said inner downwardly extending limb is formed by a first bend in the cover and said outer upwardly extending limb is formed by a second bend in the cover.

* * * * *